US005211025A

United States Patent [19]

Ni et al.

[11] Patent Number: 5,211,025

[45] Date of Patent: May 18, 1993

[54] SLUG SURGE SUPPRESSOR FOR REFRIGERATION AND AIR CONDITIONING SYSTEMS

[75] Inventors: Shimao Ni, Westmont; Phillip C. Heitz, South Elgin, both of Ill.

[73] Assignee: H.A. Phillips & Co., St. Charles, Ill.

[21] Appl. No.: 732,189

[22] Filed: Jul. 18, 1991

Related U.S. Application Data

[63] Continuation-in-part of Ser. No. 487,682, Mar. 2, 1990, Pat. No. 5,058,395.

[51] Int. Cl.[5] ..... G01K 13/00

[52] U.S. Cl. ..... 62/129; 62/196.4; 62/278; 62/503; 55/175

[58] Field of Search ..... 62/196.4, 83, 129, 278, 62/277, 503, 511, 81, 125, 126, 129; 55/475; 138/41, 44, 45, 46

[56] References Cited

U.S. PATENT DOCUMENTS

| | | | |
|---|---|---|---|
| 2,344,215 | 3/1944 | Soling et al. | 62/6 |
| 2,512,758 | 6/1950 | Winkler | 62/278 |
| 2,546,594 | 3/1951 | Gray | 62/474 |
| 3,626,715 | 12/1971 | Bottum | 62/217 |
| 4,625,524 | 12/1986 | Kimura et al. | 62/278 |
| 4,768,355 | 9/1988 | Breuhan et al. | 62/474 |
| 4,811,571 | 3/1989 | Mayer | 62/474 |

FOREIGN PATENT DOCUMENTS 178240 1/1905 Fed. Rep. of Germany .

*Primary Examiner*—John Sollecito
*Attorney, Agent, or Firm*—Willian Brinks Olds Hofer Gilson & Lione

[57] ABSTRACT

A refrigeration and defrost system utilizing various valves for opening a defrost line to hot gas and regulating the pressure in refrigerant lines. A slug surge suppressor is provided at several points in the defrost and refrigerant lines to alleviate hydraulic shock damage caused by liquid/gas "slugs" passing rapidly through the lines. The slugs are commonly formed by the required rapid opening of the various valve of the system. Capillary passages in the suppressor resist liquid flow while allowing gas to flow freely.

15 Claims, 5 Drawing Sheets

SLUG SURGE SUPPRESSOR FOR REFRIGERATION AND AIR CONDITIONING SYSTEMS

RELATED APPLICATIONS

This application is a continuation-in-part of a commonly assigned U.S. Pat. No. 5,058,395, application Ser. No. 07/487,682, filed Mar. 2, 1990, also entitled SLUG SURGE SUPPRESSOR FOR REFRIGERATION AND AIR CONDITIONING SYSTEMS.

This invention is generally related to a commonly assigned U.S. patent application, now abandoned, having Ser. No. 07/417,927, filed Oct. 6, 1989, now abandoned entitled SHOCKLESS SYSTEM AND GAS VALVE FOR REFRIGERATION AND AIR CONDITIONING. This invention is also related to a continuation-in-part from the SHOCKLESS SYSTEM ... application, the continuation-in-part having the same title and bearing U.S. Pat. No. 5,070,707 and application Ser. No. 07/487,683. The disclosures of the above patents and applications are incorporated herein by reference.

FIELD OF INVENTION

This invention relates generally to the field of refrigeration and air conditioning. More particularly, this invention relates to preventing hydraulic shock in refrigeration gas lines for industrial and commercial refrigeration and air conditioning systems.

BACKGROUND OF THE INVENTION

A conventional system for industrial and commercial refrigeration or air conditioning might employ ammonia, for example, as a refrigerant. The ammonia, in gaseous form, is compressed in a compressor, from which it is discharged at a higher temperature and pressure. The compressed refrigerant gas travels to a condenser where it is liquified at a lower temperature. Cooled liquid refrigerant then travels through evaporator coils where it performs its cooling or refrigeration function by removing heat from the surrounding environment through the coils.

The evaporator coils normally accumulate frost during operation. Periodically, these evaporator coils have to be defrosted in order to maintain the efficiency of the system. There are four widely used methods of defrosting evaporator coils. These might be characterized as the air method, the water method, the electric method, and the hot gas method.

The hot gas defrost method is the most popular of the four. In the hot gas defrost method, the supply of liquid refrigerant to the evaporator coils is interrupted and high pressure refrigerant vapor is delivered to the evaporator. While the high pressure refrigerant vapor is being delivered to the evaporator coils, the outlet of the coils is restricted so that a pressure is maintained in the coils. This provides a saturation temperature high enough to transfer heat to the frost or ice on the evaporator coils. As a result of this manipulation, the evaporator coils temporarily becomes condenser coils. The latent heat given off into the frost during the condensation process is the major energy source for the defrost.

To begin the defrost cycle, a first solenoid valve downstream of the condenser is closed and a second solenoid valve in a bypass line is opened. The bypass line leads directly from upstream of the condenser to upstream of the evaporator. The solenoid valves normally open and close rapidly. When the bypass line has some liquid in it in addition to the hot gas from the compressor (as is frequently the case), a "slug" of liquid or a liquid-gas mixture rapidly passes through the second solenoid valve and strikes downstream system components, including the evaporator. What is known as "hydraulic shock" occurs and, particularly where the system is operating at low temperatures, severe damage to the system can result.

A primary object of the invention is to provide an improved shockless, hot gas defrost refrigeration system for industrial and commercial refrigeration and air conditioning and the like.

It is another object to provide an improved refrigeration system wherein hydraulic shock damage to system components due to rapid opening of control valves is prevented.

Yet another object is to provide a refrigeration system wherein slug flow in the pipe line is prevented from rapidly moving downstream so as to cause hydraulic shock, a result potentially damaging to system components.

SUMMARY OF THE INVENTION

The foregoing and other objects are realized in accordance with the present invention by providing a slug surge suppressor device interposed in the gas line of a refrigeration system. The slug surge suppressor is advantageously placed downstream of the solenoid valve in the hot gas line. The slug surge suppressor may also be placed downstream of a pressure regulator valve, which is downstream of the evaporator in a suction line.

In one aspect of the invention, the slug surge suppressor comprises a plurality of beads, fibers or other materials that act together to form capillary passages. The beads are generally confined by first and second perforated screens, at least one of which may be movable. The capillary passages resist liquid flow and lower liquid pressure. However, the passages also allow gas to flow freely without a significant drop in gas pressure. The pressure drop in the liquid not only moderates (i.e., slows down) the slug surge, but also makes the liquid evaporate rapidly. The movable screens absorb part of the shock from the slug surge and thereby stabilizes the device.

In another aspect of the invention, the features described above include an alarm system and a third perforated screen located downstream from at least one of the first and second perforated screens. The third screen is electrically insulated from the first and second screens. The system sounds an alarm when the screen that is immediately upstream from the third screen breaks. The third screen confines the beads and prevent them from traveling downstream and causing damage to system components.

BRIEF DESCRIPTION OF THE DRAWINGS

The invention, including its construction and method of operation, together with additional objects and advantages thereof, is illustrated more or less diagrammatically in the drawings, in which.

DESCRIPTION OF THE PREFERRED EMBODIMENTS

Figure 1:
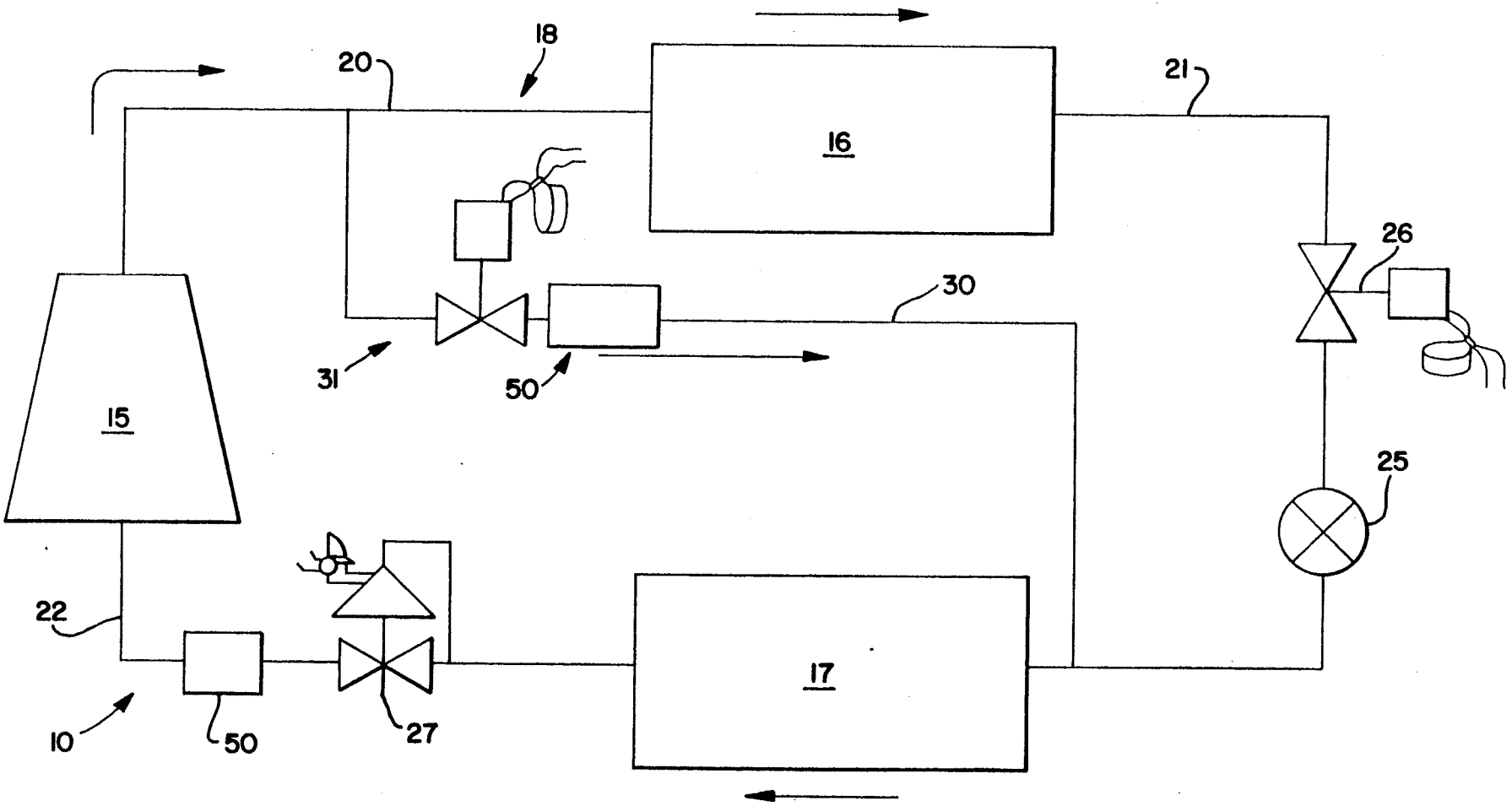
FIG. 1 is a block diagram of a system embodying features of the present invention.

Referring now to the drawings, and particularly to FIG. 1, a system embodying the features of the present invention is illustrated in block diagram at 10. The system 10 is illustrated in the context of a commercial refrigeration system and includes a refrigerant compressor 15 in closed circuit with a condenser 16 and an evaporator 17, all of which are connected by a pipe assembly 18. The compressor 15 and the condenser 16 are connected by a pipe segment 20; the condenser and evaporator are connected by a pipe segment 21; and the evaporator and compressor are connected by a pipe segment 22. These components are of known construction and arrangement and are commercially available.

The pipe segment 21 includes an expansion valve 25. Upstream, next to the expansion valve 25, a solenoid operated control valve 26 is mounted in the pipe segment 21. During hot gas defrost, the control valve 26 closes communication between the condenser 16 and the evaporator 17.

The pipe segment 22 includes a pressure regulator valve 27, which is located downstream of the evaporator 17 and upstream of the compressor 15. The pressure regulator valve 27 regulates the flow of gaseous refrigerant to the compressor from the evaporator.

The system 10 also includes a hot gas defrost pipe segment 30. One end of the pipe segment 30 is connected to the pipe segment 20 upstream of the condenser 16. The other end of the pipe segment 30 is connected to the pipe segment 21 downstream of the expansion valve 25 and upstream of the evaporator 17. A solenoid operated defrost valve 31 is disposed in the hot gas defrost pipe segment 30. A first slug surge suppressor device 50 embodying the features of the present invention is located directly downstream of the solenoid valve 31. A second suppressor device 50, essentially identical to the first, is located directly downstream of the pressure regulator valve 27.

In the normal operation of the system 10 as a refrigeration system, the evaporator 17 converts cooled liquid refrigerant to a gas, thereby removing heat from the surrounding environment. The compressor 15 receives the gas from the evaporator 17 through the pressure regulator valve 27. The gas is then compressed by the compressor 15, after which it passes downstream through the pipe 20 into the condenser 16.

The condenser 16 liquifies the pressurized gas by removing heat from the gas. The liquified refrigerant leaves the condenser 16 through the pipe segment 21 and travels (via valve 26) to the expansion valve 25. The expansion valve 25 reduces the pressure of the liquified refrigerant and returns it downstream to the evaporator 17.

During a refrigeration operation of the aforedescribed nature, it is not unusual for the evaporator coils to accumulate frost as the system operates. This frost builds-up is especially rapid where the system operates in a high humidity environment. As the frost builds up, the refrigeration efficiency of the evaporator coils is reduced.

Normally the hot gas defrost pipe segment 30 is closed by the hot gas defrost valve 31; the pipe segment 21 remains open through valve 26; and the pipe segment 22 remains open through the pressure regulator valve 27. When a defrost cycle is called for, the valve 26 is closed and the hot gas defrost valve 31 is opened. The pressure regulator valve 27 is then de-energized and regulates the pressure in the evaporator 17.

When the valve 26 is closed and the hot gas defrost valve 31 is opened, high pressure refrigerant gas is delivered to the evaporator 17. While this high-pressure gas is being supplied to the evaporator 17, the outlet from the evaporator 17 is restricted by the pressure regulator valve 27. As a result, sufficient pressure is maintained in the evaporator coils to provide a saturation temperature that is high enough to melt the frost. During defrost, the evaporator coils essentially function as a condenser.

During hot gas defrost, the pipe segment 30 can contain liquid in addition to the hot gas from the compressor 15. As a result, a slug, comprising either liquid or a liquid-gas mixture, rapidly passes through the valve 31 and strikes downstream system components, including the evaporator. When the hot gas defrost process is finished, the pressure regulator valve 27 is energized and the main passage of the valve 27 opens rapidly. The pressure that built up in the evaporator 17 during defrost is much higher than the suction pressure, thus creating a pressure differential that can move the liquid-gas slug in the evaporator 17 rapidly downstream. As the slug "surges" into downstream components, serious damage can result.

In order to prevent the rapid passage of slugs through the system, the slug surge suppressors 50A–50C of the present invention have been developed. The slug surge suppressors 50, as seen in FIG. 1, are positioned downstream of the hot gas defrost valve 31 in the pipe segment 30, and downstream of the pressure regulatory valve 27 in the pipe segment 22.

Figure 2:
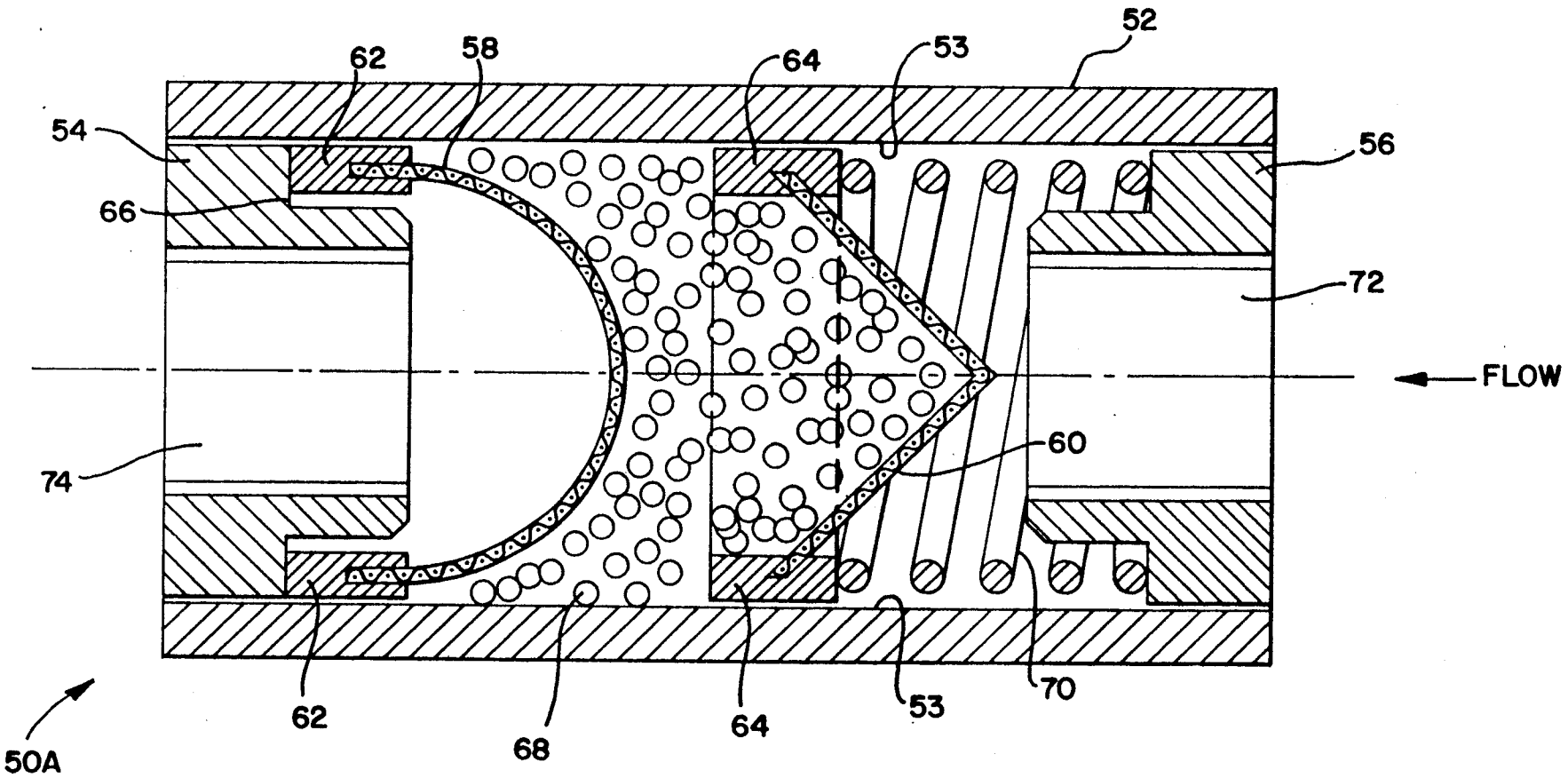
FIG. 2 is a partial sectional view of a first embodiment of a slug surge suppressor for the system illustrated in FIG. 1.

Referring now to FIG. 2, a first embodiment of the slug surge suppressor is illustrated in detail at 50A. The slug surge suppressor 50A generally comprises a cylindrical body 52 having pipe fitting elements 54 and 56, each located at opposite ends of the cylindrical body 52. The pipe fitting elements 54, 56 are preferably welded in place to an inside wall 53 of the cylindrical body 52. A dome-shaped perforated screen 58 is attached around its edge to a first ring-shaped holder 62. The ring-shaped holder 62 fits inside a circular groove formed by a shoulder element 66 and the inner wall 53 of the cylindrical body 52.

A cone-shaped perforated screen 60 is attached around its edge to a second ring-shaped holder 64, which fits movably against the inner wall 53 of the cylindrical body 52. The cone-shaped screen 60 and second holder 64 are located upstream from the dome-shaped screen 58 and first holder 62. A plurality of beads are located between the screens 58, 60. The beads 68 form capillary passages in the area between the screens 58, 60.

A coil spring 70 is between the cone-shaped screen 60 and pipe fitting element 56. The spring 70 is biased at one end against the second holder 64 and at its other end against pipe fitting element 56. Thereby, the second holder 64 and the cone-shaped screen 60 are movably positioned against the beads 68.

In operation, a slug (not shown), comprised of either liquid or a liquid-gas mixture, rapidly advances through the pipe segment 30 into the inlet port 72. The slug strikes against and passes through the cone-shaped screen 60. The non-planar shapes of the screens 58, 60 place less stress on them and make them stronger. Thus, the screens 58, 60 resist breakage upon impact with the slug. Also, the movable screen 60 and the spring 70 provide additional ability to absorb some of the impact of the rapidly moving slug.

The liquid-gas slug then passes through the beads 68. The spaces between the beads 68 form capillary passages, which resist the flow of liquid. At the same time, these passages present little resistance to gas flow and no significant gas pressure drop. The beads, resistance to liquid flow also lowers the liquid pressure, thereby flashing (i.e., vaporizing) most of liquid. The vaporized liquid then passes easily through the beads 68 in the same manner described above for the gaseous component of the slug. The remaining unvaporized liquid is slowed down significantly as it passes through the beads 68 and the dome-shaped screen 58 to the outlet port 74. Thereby, slug surge is prevented.

Figure 3:
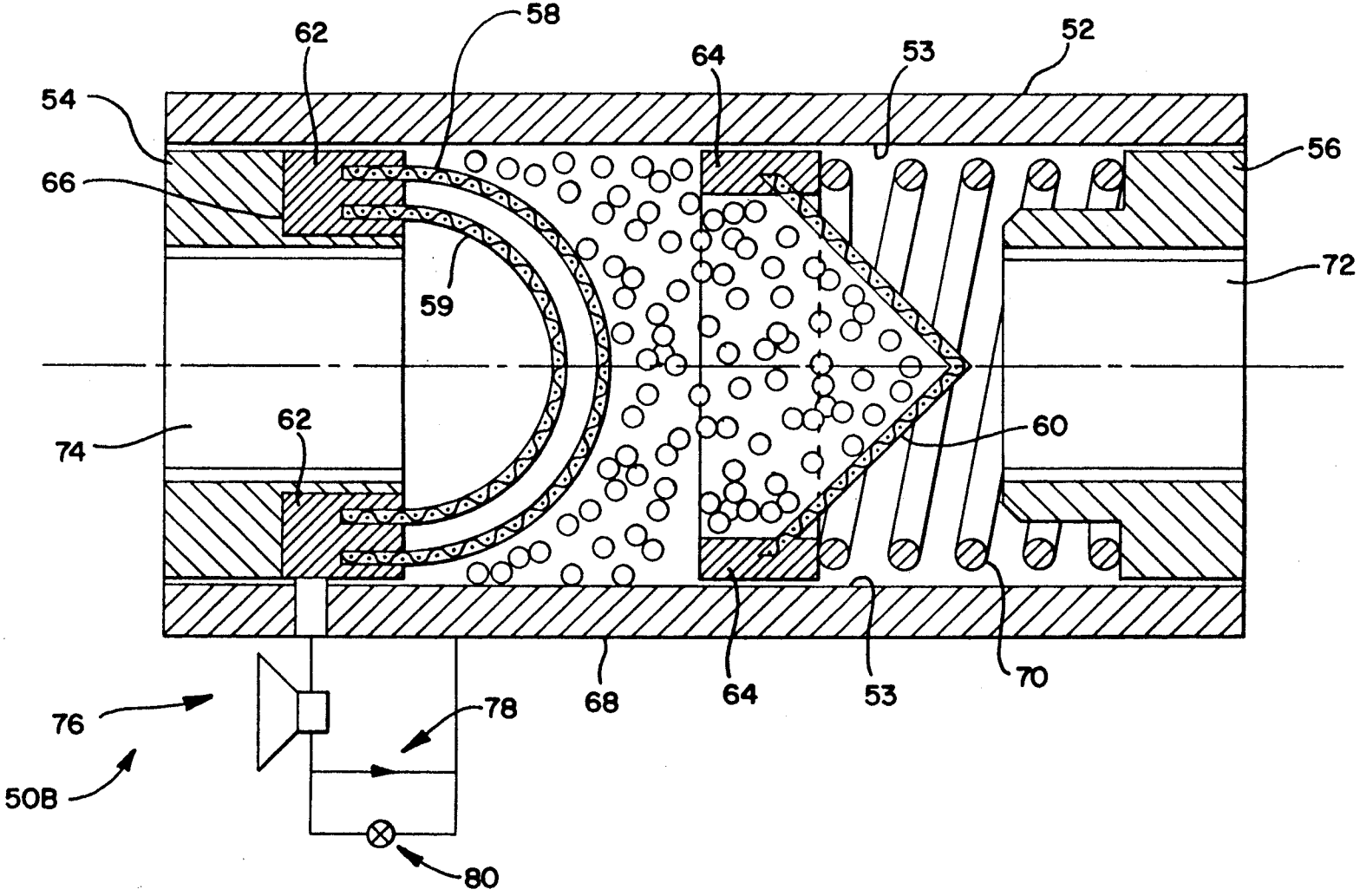
FIG. 3 is a partial sectional view of a second embodiment of a slug surge suppressor for the system of FIG. 1.

Referring now to FIG. 3 a second embodiment of the slug surge suppressor is illustrated in detail at 50B. The slug surge suppressor shown at 50B is identical to the device shown at 50A in FIG. 2, except for the addition of a second dome-shaped screen 59 and an alarm system for detecting breakage of the first dome-shaped screen 58.

If the dome-shaped screen 58 breaks, the beads 68 pass through the outlet port 74 and cause damage to downstream system components. To prevent this, the second dome-shaped screen 59 is provided as shown in FIG. 3.

The two screens 58 and 59 are electrically insulated from each other. An alarm 76 is connected in series with the second dome-shaped screen 59 and one terminal of a battery 78. A second terminal of the battery 78 is connected in series with the cylindrical body 52, the beads 68, and the first dome-shaped screen 58. Thus, there is a short between the screens 58 and 59.

If the first dome-shaped screen 58 breaks, the beads 68 will move into the space between the screens and complete the circuit from the battery 78 to the alarm 76 (In this regard, the beads 68, screens 59 and 58, and the cylindrical body 52 should all be made from electrically conductive material). Thus, the alarm sounds, notifying the user that the first screen has broken.

Although the alarm 76 warns the user that one screen has broken, the unit is still completely functional since the second dome-shaped screen 59 confines the beads 68 and prevents them from traveling downstream. The screens typically last many years before breakage, and thus, a battery indicator 80 is included to signal the user whenever the battery 78 is dead.

Figure 4:
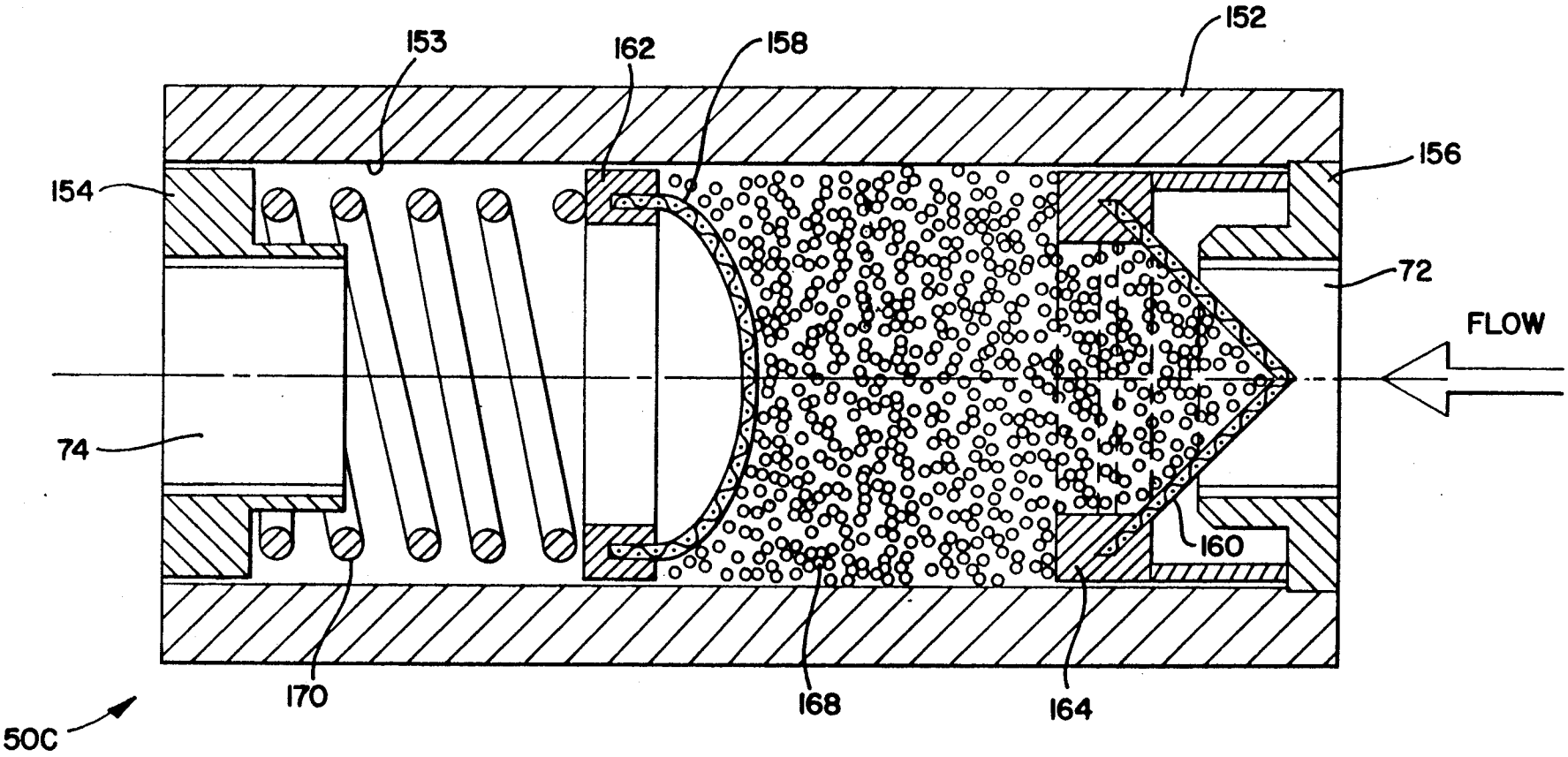
FIG. 4 is a partial sectional view of a third embodiment of a slug surge suppressor for the system of FIG. 1.

Referring now to FIG. 4, a third embodiment of the slug surge suppressor is illustrated in detail at 50C. Like the device shown at 50A, the slug surge suppressor 50C generally comprises a cylindrical body 152 having pipe fitting elements 154 and 156, each located at opposite ends of the cylindrical body 152. The pipe fitting elements 154, 156 are preferably welded in place to an inside wall 153 of the cylindrical 152. A dome-shaped perforated screen 158 is attached around its edge to a first ring-shaped holder 162. However, unlike the embodiment shown at 50A, the first holder 162 fits movably against the inner wall 153 of the cylindrical body 152.

A cone-shaped perforated screen 160 is attached around its edge to a second ring-shaped holder 164. The cone-shaped screen 160 and second holder 164 are located upstream from the dome-shaped screen 158 and first holder 162. A plurality of beads are located between the screens 158, 160. The beads 168 form capillary passages in the area between the screens 158, 160.

A coil spring 170 is located between the dome-shaped screen 158 and pipe fitting element 154. The spring 170 is biased at one end against the second holder 162 and at its other end against the pipe fitting element 154. Thereby, the second holder 162 and the dome-shaped screen 158 are movably positioned against the beads 168.

In operation, a slug (not shown), comprised of either liquid or a liquid-gas mixture, rapidly advances through the pipe segment 30 into the inlet port 72. The slug strikes against and passes through the cone-shaped screen 160. The non-planar shapes of the screens 158, 160 place less stress on the screens and make them stronger. Thus, the screens 58, 60 resist breakage upon impact with the slug.

The liquid gas slug then passes through the beads 168. The spaces between the beads 168 form capillary passages, which resist the flow of liquid. At the same time, these passages present little resistance to gas flow and no significant gas pressure drop. The beads, resistance to liquid flow also lowers the liquid pressure, thereby flashing (i.e. vaporizing) most of the liquid. The vaporized liquid then passes easily through the beads 168 in the same manner described above for the gaseous component of the slug. The remaining unvaporized liquid is slowed down significantly as it passes through the beads 168 and the dome-shaped screen 158 to the outlet port 74. Thereby, slug surge is prevented.

The downstream position of the dome-shaped screen 168 and the coil spring 170, further increases the ability of the screen 168 to absorb the impact of a rapidly moving slug. Thus, the slug surge suppressor device 50C shown in FIG. 4 is particularly suited to absorbing the shock of a rapidly moving slug.

Figure 5:
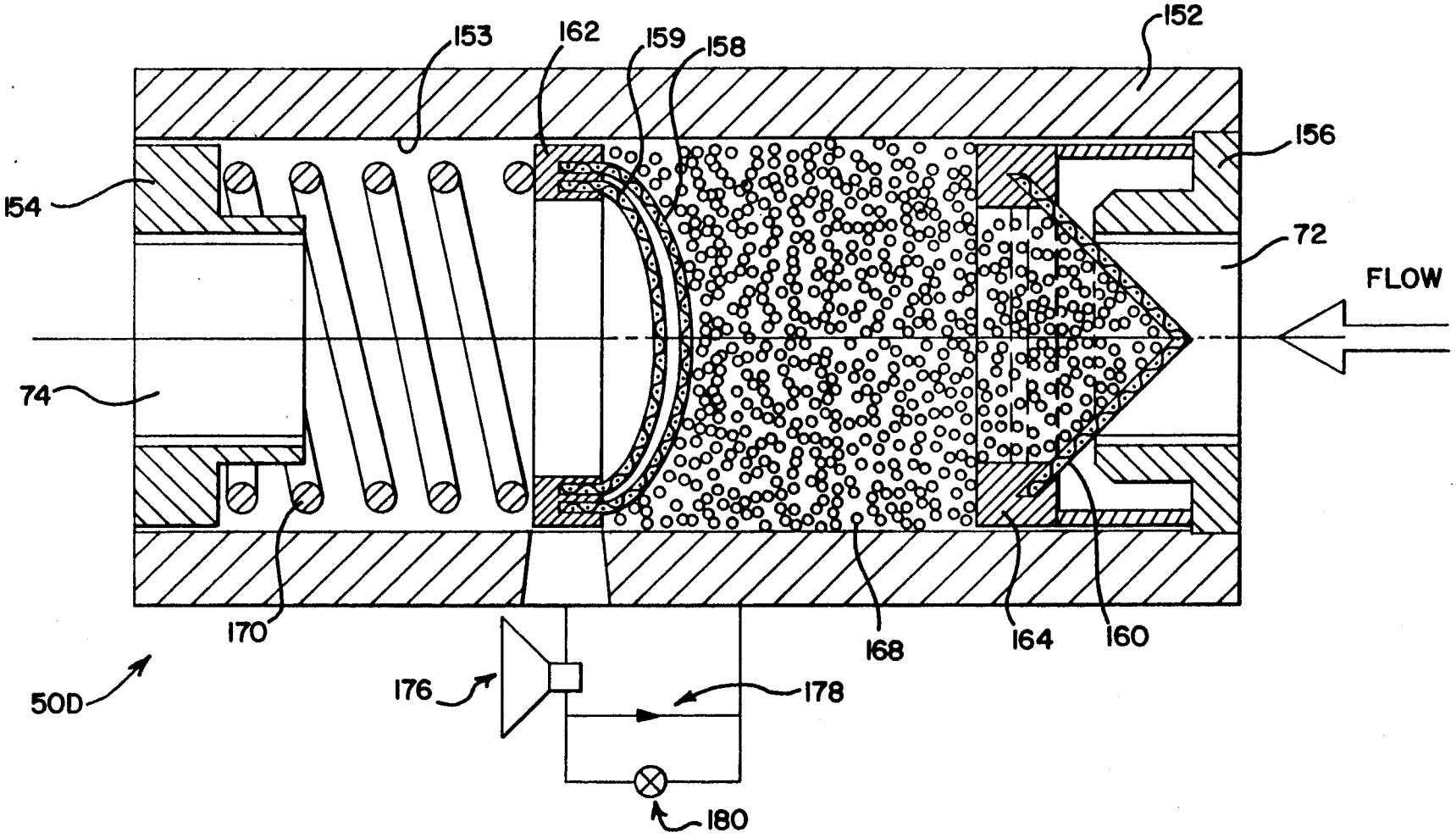
FIG. 5 is a partial sectional view of a fourth embodiment of a slug surge suppressor for the system of FIG. 1.

FIG. 5 illustrates a fourth embodiment of the slug surge suppressor at 50D. The fourth embodiment 50D takes the same alarm system described in the second embodiment 50B and applies this system to the surge suppressor 50C of the third embodiment.

If the dome-shaped screen 158 breaks, the beads 168 pass through the outlet port 174, and cause damage to downstream system components. To prevent this, a second dome-shaped screen 159 is provided as shown in FIG. 5.

The two screens 158 and 159 are electrically insulated from each other. An alarm 176 is connected in series with the second dome-shaped screen 159 and one terminal of a battery 178. The second terminal of the battery 178 is connected in series with the cylindrical body 152, the beads 68, and the first dome-shaped screen 158. Thus, there is a short between the screens 158 and 159.

If the first dome-shaped screen breaks, the beads 168 move into the space between the screens and complete the circuit from the battery 178 to and the alarm 176 (In this regard, the beads 168, screens 159 and 158, and the cylindrical 152 should all be made from electrically conducted material). Thus, the alarm sounds notifying the user that the first screen has broken. As with the embodiment shown at 50B, a battery indicator 180 is included to signal the user whenever the battery 178 is dead.

Because the screens 158 and 159 are movable against a bias 170, the electrical connection between the alarm 176 and the second dome-shaped 159 should be arranged to maintain the connection throughout the various positions of the screens 158 and 159. The particular details of the electrical connection are well within the capability of the ordinary practitioner, and thus, will not be described in detail here.

In the embodiments shown in FIGS. 3 and 5, there is a close proximity between the electrical connections and the refrigerant. Thus, it is preferable to operate the devices shown at 50B and 50D in a system 10 that utilizes a substantially nonflammable refrigerant, such as freon. Otherwise, a spark from the alarm system may ignite the refrigerant. Although proper insulation is desirable in any electric system, if a flammable refrigerant (such as ammonia) is used, the electrical connections for the devices 50B and 50D may include additional insulation to reduce the risk of sparks contacting the refrigerant.

While preferred embodiments of the invention have been described, it should be understood that the invention is not limited to them and modifications may be made without departing from the invention. For example, the slug surge suppressor of the present invention is not restricted to use in hot gas defrost systems, but may be used in any refrigeration system in which slug surge may be present. The scope of the invention is defined by the appended claims, and all devices that come within the meaning of the claims, either literally or by equivalents, are intended to be embraced therein.

I claim:

1. An improved refrigeration and defrost system wherein shock damage to system components due to rapid passage of a slug through the system is prevented, the system comprising:

a) a refrigerant compressor connected in closed circuit with a condenser and an evaporator by a pipe assembly;

b) said pipe assembly including a first pipe segment connecting the compressor and the condenser, a second pipe segment connecting the condenser and the evaporator, and a third pipe segment connecting the evaporator and the compressor;

c) a hot gas defrost pipe segment connected to said first pipe segment and the second pipe segment of said pipe assembly;

d) a hot gas defrost valve disposed in said hot gas defrost pipe segment, said hot gas defrost valve including means for opening said hot gas defrost pipe segment to a maximum extent to permit hot gas to flow therethrough during a hot gas defrost cycle; and e) a first slug surge suppressor disposed in said hot gas defrost pipe segment and downstream from said hot gas defrost valve, said slug surge suppressor comprising:

1) a plurality of capillary passages operative to resist liquid flow by viscous effects and allow gas flow without significant pressure drop; and 2) a first perforated screen movably located inside the slug surge suppressor.

2. The system defined in claim 1 including:

a) a pressure regulatory valve disposed in said third pipe segment, said pressure regulatory valve including means for regulating evaporator pressure during said hot gas defrost cycle and opening said third pipe segment to a maximum extend during a refrigeration cycle to permit gas to flow therethrough; and b) a second slug surge suppressor disposed in said third pipe segment downstream from said regulatory valve.

3. The system defined in claim 1 wherein said slug surge suppressor further includes:

a) a body having contiguous inlet and outlet ports, said ports connecting said slug surge suppressor to said pipe segment; and b) a second perforated screen located inside said body and disposed between said inlet port and said outlet port such that the slug passing from said inlet port to said outlet port will pass through said first perforated screen and said second perforated screen;

c) said plurality of capillary passages being confined in the space between said first perforated screen and said second perforated screen.

4. The system defined in claim 3 wherein said slug surge suppressor further includes;

a) said second perforated screen located downstream of said first perforated screen;

b) a third perforated screen located downstream of said second screen and electrically insulated therefrom;

c) an electrically activated alarm means having a pair of terminals, the first of said alarm terminals being electrically connected to said third screen;

d) an electrical power source having a pair of terminals, the first of said power source terminals being electrically connected to the second of said alarm terminals, and the second of said power source terminals being electrically connected to said body;

e) an electrically conductive material forming said body; and f) electrically conductive material forming said capillary passages and contacting said body and said second screen;

g) whereby breakage of said second screen allows said electrically conductive material forming said capillary passages to contact said third screen, thereby completing the circuit between said alarm and said power source and sounding said alarm.

5. The system defined in claim 3 wherein said slug surge suppressor further includes;

a) said first perforated screen located downstream of said second perforated screen;

b) a third perforated screen located downstream of said first screen and electrically insulated therefrom;

c) an electrically activated alarm means having a pair of terminals, the first of said alarm terminals being electrically connected to said third screen;

d) an electrical power source having a pair of terminals, the first of said power source terminals being electrically connected to the second of said alarm terminals, and the second of said power source terminals being electrically connected to said body;

e) an electrically conductive material forming said body; and f) electrically conductive material forming said capillary passages and contacting said body and said first screen;

g) whereby breakage of said first screen allows said electrically conductive material forming said capillary passages to contact said third screen, thereby completing the circuit between said alarm and said power source and sounding said alarm.

6. The system defined in claim 3 wherein:

a) said first perforated screen is movable against a spring bias; and b) said second perforated screen in located downstream of said first perforated screen.

7. The system defined in claim 3 wherein:

a) said first perforated screen is movable against a spring bias; and b) said first perforated screen is located downstream of said second perforated screen.

8. The system defined in claim 3 wherein at least one of said first and second perforated screens is non planar.

9. In a refrigeration and defrost system including a refrigerant compressor connected in closed circuit with a condenser and an evaporator by a pipe assembly, the improvement comprising:

a) a slug surge suppressor disposed in said pipe assembly and including:

1) a plurality of capillary passages operative to resist liquid flow by viscous effects and allow gas flow without significant pressure drop; and 2) a first perforated screen movably located inside said slug surge suppressor;

b) said plurality of capillary passages and said first perforated screen are configured to define means whereby said first perforated screen absorbs the shock from the rapid impact of a slug, thereby preventing shock damage to said slug surge suppressor and system components downstream of said slug surge suppressor.

10. The system defined in claim 9 wherein said slug surge suppressor further comprises:

a) a body having contiguous inlet and outlet ports, said ports connecting said slug surge suppressor to said pipe assembly; and b) a second perforated screen located inside said body and disposed such that said plurality of capillary passages are confined in the space between said first perforated screen and said second perforated screen.

11. The system defined in claim 10 wherein said slug surge suppressor further includes;

a) said second perforated screen located downstream of said first perforated screen;

b) a third perforated screen located downstream of said second screen and electrically insulated therefrom;

c) an electrically activated alarm means having a pair of terminals, the first of said alarm terminals being electrically connected to said third screen;

d) an electrical power source having a pair of terminals, the first of said power source terminals being electrically connected to the second of said alarm terminals, and the second of said power source terminals being electrically connected to said body;

e) an electrically conductive material forming said body; and f) electrically conductive material forming said capillary passages and contacting said body and said second screen;

g) whereby breakage of said second screen allows said electrically conductive material forming said capillary passages to contact said third screen, thereby completing the circuit between said alarm and said power source and sounding said alarm.

12. The system defined in claim 10 wherein said slug surge suppressor further includes;

a) said first perforated screen located downstream of said second perforated screen;

b) a third perforated screen located downstream of said first screen and electrically insulated therefrom;

c) an electrically activated alarm means having a pair of terminals, the first of said alarm terminals being electrically connected to said third screen;

d) an electrical power source having a pair of terminals, the first of said power source terminals being electrically connected to the second of said alarm terminals, and the second of said power source terminals being electrically connected to said body;

e) an electrically conductive material forming said body; and f) electrically conductive material forming said capillary passages and contacting said body and said first screen;

g) whereby breakage of said first screen allows said electrically conductive material forming said capillary passages to contact said third screen, thereby completing the circuit between said alarm and said power source and sounding said alarm.

13. The system defined in claim 10 wherein:

a) said first perforated screen is movable against a spring bias; and b) said second perforated screen in located downstream of said first perforated screen.

14. The system defined in claim 10 wherein:

a) said first perforated screen is movable against a spring bias; and b) said first perforated screen is located downstream of said second perforated screen.

15. The system defined in claim 10 wherein at least one of said first and second perforated screens is nonplanar.

* * * * *